US012616242B2

(12) United States Patent
Dittmann et al.

(10) Patent No.: US 12,616,242 B2
(45) Date of Patent: May 5, 2026

(54) AEROSOL-GENERATOR COMPRISING MULTIPLE SUPPLY ELEMENTS

(71) Applicant: Philip Morris Products S.A., Neuchatel (CH)

(72) Inventors: Leander Dittmann, Neuchatel (CH); Robert Emmett, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 616 days.

(21) Appl. No.: 17/787,777

(22) PCT Filed: Dec. 22, 2020

(86) PCT No.: PCT/EP2020/087618
§ 371 (c)(1),
(2) Date: Jun. 21, 2022

(87) PCT Pub. No.: WO2021/130220
PCT Pub. Date: Jul. 1, 2021

(65) Prior Publication Data

US 2023/0088017 A1 Mar. 23, 2023

(30) Foreign Application Priority Data

Dec. 23, 2019 (EP) ..... 19219419

(51) Int. Cl.
*A24F 40/05* (2020.01)
*A24F 40/10* (2020.01)
(Continued)

(52) U.S. Cl.
CPC ..... *A24F 40/05* (2020.01); *A24F 40/10* (2020.01); *A24F 40/48* (2020.01); *A24F 40/50* (2020.01)

(58) Field of Classification Search
None
See application file for complete search history.

(56) References Cited

U.S. PATENT DOCUMENTS 9,022,639 B2 * 5/2015 Burkhardt ..... B29C 48/405 366/85
2005/0042170 A1 2/2005 Jiang et al.
(Continued)

FOREIGN PATENT DOCUMENTS

CN 2777951 Y 5/2006
CN 204963363 U * 1/2016
(Continued)

OTHER PUBLICATIONS

Machine translation of CN 204963363 U (Year: 2024).*
(Continued)

*Primary Examiner* — Michael H. Wilson
*Assistant Examiner* — Tobey C Le
(74) *Attorney, Agent, or Firm* — Oblon, McClelland, Maier & Neustadt, L.L.P.

(57) ABSTRACT

An aerosol-generator for an aerosol-generating device is provided, including: a surface acoustic wave atomiser including: a substrate including an active surface defining an atomisation region, first and second transducers positioned on the active surface; first and second supply elements to respectively supply first and second liquid aerosol-forming substrates to the atomisation region; a controller to provide first and second drive signals respectively to the first and the second transducers to generate surface acoustic waves on the active surface, provide the first drive signal only when the first substrate is supplied to the atomisation region by the first supply element, and provide the second drive signal only when the second substrate is supplied to the atomisation region by the second supply element. An aerosol-generating device including the aerosol-generator is also provided.

8 Claims, 4 Drawing Sheets

(51) Int. Cl.
*A24F 40/48* (2020.01)
*A24F 40/50* (2020.01)

(56) References Cited

U.S. PATENT DOCUMENTS

| | | | | |
|---|---|---|---|---|
| 2012/0187209 | A1 | 7/2012 | Friend et al. | |
| 2015/0110763 | A1 | 4/2015 | Leach | |
| 2017/0157341 | A1* | 6/2017 | Pandya | A61M 11/042 |
| 2017/0280771 | A1* | 10/2017 | Courbat | B05B 17/0661 |
| 2018/0141073 | A1* | 5/2018 | Tan | B06B 1/0644 |
| 2021/0022406 | A1* | 1/2021 | Minami | B05B 17/0607 |

FOREIGN PATENT DOCUMENTS

| | | | | | |
|---|---|---|---|---|---|
| CN | 108471812 | A | | 8/2018 | |
| CN | 108697178 | A | | 10/2018 | |
| CN | 109068750 | A | | 12/2018 | |
| JP | H11207224 | A | * | 8/1999 | B05B 17/0607 |
| JP | 2008-104974 | A | | 5/2008 | |
| JP | 2018/139628 | A | | 9/2018 | |
| RU | 2 427 392 | C2 | | 8/2011 | |
| RU | 2 690 401 | C2 | | 6/2019 | |
| WO | WO-2010069932 | A1 | * | 6/2010 | B05B 17/0646 |
| WO | WO 2010/129994 | A1 | | 11/2010 | |
| WO | WO 2017/167521 | A1 | | 10/2017 | |
| WO | WO 2018/178113 | A2 | | 10/2018 | |
| WO | WO-2019191816 | A1 | * | 10/2019 | A61M 11/005 |

OTHER PUBLICATIONS

Machine translation of JP H11207224 A (Year: 2025).*
Combined Chinese Office Action and Search Report issued Sep. 27, 2023 in Chinese Patent Application No. 202080089319.X (with English Translation), 16 pages.
International Search Report issued Feb. 16, 2021 in PCT/EP2020/087618 filed on Dec. 22, 2020, 3 pages.
Written Opinion issued Feb. 16, 2021 in PCT/EP2020/087618 filed on Dec. 22, 2020, 5 pages.
Combined Russian Office Action and Search Report issued Apr. 3, 2024 in Russian Patent Application No. 2022120092/14 (with English Translation of Office Action only), 9 pages.
Japanese Notice of Allowance issued Feb. 3, 2025, in corresponding Japanese Patent Application No. 2022-537435, 1 page.
Korean Office Action dated Aug. 20, 2025, in corresponding Korean Patent Application No. 10-2022-7025001 (with English Translation) 11 pages.

* cited by examiner

AEROSOL-GENERATOR COMPRISING MULTIPLE SUPPLY ELEMENTS

The present disclosure relates to an aerosol-generator for an aerosol-generating device, the aerosol-generator comprising a surface acoustic wave atomiser, and first and second supply elements. The present disclosure also relates to an aerosol-generating device comprising the aerosol-generator.

Aerosol-generating systems in which an aerosol-forming substrate is heated rather than combusted are known in the art. Typically in such aerosol-generating systems, an aerosol is generated by the transfer of energy from an aerosol-generator of an aerosol-generating device to an aerosol-forming substrate. For example, known aerosol-generating devices comprise a heater arranged to heat and vaporise a liquid aerosol-forming substrate.

Typically, an aerosol-generating device is designed and optimised for vaporising or atomising a particular liquid aerosol-forming substrate. For example, an aerosol-generating device may be designed an optimised for vaporising a liquid having a particular volatility, viscosity, and so forth.

It would be desirable to provide an aerosol-generator for an aerosol-generating device that facilitates the atomisation of multiple liquid aerosol-forming substrates.

According to a first aspect of the present disclosure there is provided an aerosol-generator for an aerosol-generating device. The aerosol-generator comprises a surface acoustic wave atomiser, a first supply element, a second supply element, and a controller. The surface acoustic wave atomiser comprises at least one substrate comprising an active surface defining at least one atomisation region. The surface acoustic wave atomiser also comprises a first transducer positioned on the active surface of the at least one substrate and a second transducer positioned on the active surface of the at least one substrate. The first supply element is arranged to supply a first liquid aerosol-forming substrate to the at least one atomisation region. The second supply element is arranged to supply a second liquid aerosol-forming substrate to the at least one atomisation region. The controller is configured to provide a first drive signal to the first transducer for generating surface acoustic waves on the active surface of the at least one substrate. The controller is configured to provide a second drive signal to the second transducer for generating surface acoustic waves on the active surface of the at least one substrate. The controller is configured to provide the first drive signal to the first transducer only when the first liquid aerosol-forming substrate is supplied to the at least one atomisation region by the first supply element. The controller is configured to provide the second drive signal to the second transducer only when the second liquid aerosol-forming substrate is supplied to the at least one atomisation region by the second supply element.

The term "surface acoustic wave" is used herein to include Rayleigh waves, Lamb waves and Love waves.

Advantageously, atomising first and second liquid aerosol-forming substrates using a surface acoustic wave atomiser provides improved control of the atomisation process when compared to other known aerosol-generators, such as electric heaters. In other words, the surface acoustic wave atomiser of aerosol-generators according to the present disclosure provides reliable and consistent amounts of atomised liquid aerosol-forming substrate.

Advantageously, the power required by a surface acoustic wave atomiser for atomising a liquid aerosol-forming substrate is less than the power required for atomising the same amount of liquid aerosol-forming substrate using known aerosol-generators, such as electric heaters.

Advantageously, using a single surface acoustic wave atomiser for atomising first and second liquid aerosol-forming substrates simplifies the design and manufacture of the aerosol-generator.

Advantageously, using a surface acoustic wave atomiser comprising first and second transducers facilitates optimisation of each transducer for atomisation of the first and second liquid aerosol-forming substrates respectively.

Preferably, the at least one substrate comprises a common substrate on which the first transducer and the second transducer are positioned. Advantageously, a common substrate simplifies the design and manufacture of the surface acoustic wave atomiser.

The at least one atomisation region may be a common atomisation region. In embodiments in which the at least one substrate comprises a common substrate, the common atomisation region is defined by the common substrate.

Advantageously, providing a common substrate defining a common atomisation region may reduce or minimise the size of the surface acoustic wave atomiser. Advantageously, providing a common atomisation region may simplify the design and manufacture of an aerosol-generating device comprising the aerosol-generator. For example, providing a common atomisation region may facilitate a simple airflow path through the aerosol-generating device.

In embodiments in which the aerosol-generator comprises a common atomisation region, the aerosol-generator may comprise a common supply element providing fluid communication between the common atomisation region and each of the first supply element and the second supply element. The common supply element may comprise a common channel extending at least partially through the substrate. The common supply element may comprise a common outlet on the active surface of the substrate and positioned in the common atomisation region. Preferably, the common channel is in fluid communication with the common outlet.

The first supply element may comprise a first channel extending at least partially through the substrate. The first channel may extend between a first inlet on a passive surface of the substrate and the common channel. The first channel may be a capillary tube. The second supply element may comprise a second channel extending at least partially through the substrate. The second channel may be a capillary tube. The second channel may extend between a second inlet on a passive surface of the substrate and the common channel.

The first supply element may comprise the first transducer. During use, surface acoustic waves generated by the first transducer may draw a first liquid aerosol-forming substrate into the at least one atomisation region. In other words, the first liquid aerosol-forming substrate is drawn into the at least one atomisation region only when the controller provides the first drive signal to the first transducer. In embodiments in which the first supply element comprises a first channel, surface acoustic waves generated by the first transducer may draw a first liquid aerosol-forming substrate through the first channel.

The second supply element may comprise the second transducer. During use, surface acoustic waves generated by the second transducer may draw a second liquid aerosol-forming substrate into the at least one atomisation region. In other words, the second liquid aerosol-forming substrate is drawn into the at least one atomisation region only when the controller provides the second drive signal to the second transducer. In embodiments in which the second supply element comprises a second channel, surface acoustic waves generated by the second transducer may draw a second liquid aerosol-forming substrate through the second channel.

The first supply element may comprise a first flow control element arranged to control a flow of the first liquid aerosol-forming substrate to the common atomisation region. In embodiments in which the first supply element comprises a first channel, preferably the first flow control element is arranged to control a flow of the first aerosol-forming substrate through the first inlet and into the first channel.

The second supply element may comprise a second flow control element arranged to control a flow of the second liquid aerosol-forming substrate to the common atomisation region. In embodiments in which the second supply element comprises a second channel, preferably the second flow control element is arranged to control a flow of the second aerosol-forming substrate through the second inlet and into the second channel.

Each of the first and second flow control elements may comprise at least one passive element. The at least one passive element may comprise at least one of a capillary tube and a capillary wick.

Each of the first and second flow control elements may comprise at least one active element. The at least one active element may comprise at least one of a micro pump, a syringe pump, a piston pump, and an electroosmotic pump.

Preferably, the controller is configured to provide a first flow signal to the first flow control element to enable a flow of the first liquid aerosol-forming substrate to the common atomisation region. Preferably, the controller is configured to provide a second flow signal to the second flow control element to enable a flow of the second liquid aerosol-forming substrate to the common atomisation region. Preferably, the controller is configured to provide a first stop signal to the first control element to disable the flow of the first liquid aerosol-forming substrate when the controller provides the second flow signal to the second control element. Preferably, the controller is configured to provide a second stop signal to the second control element to disable the flow of the second liquid aerosol-forming substrate when the controller provides the first flow signal to the first control element.

Advantageously, a controller configured to provide flow signals and stop signals to first and second flow control elements may prevent concurrent supply of the first and second liquid aerosol-forming substrates to the common atomisation region. Advantageously, supplying only one of the first and second liquid aerosol-forming substrates to the common atomisation region at a time facilitates the controller driving only the first transducer or the second transducer. In other words, the need to concurrently drive the first and second transducers may be reduced or eliminated. Advantageously, reducing or eliminating the need to concurrently drive the first and second transducers may reduce the power requirements of an aerosol-generating device comprising the aerosol-generator.

The controller may be configured to alternate between providing the first flow signal and providing the second flow signal. In other words, the controller may be configured to switch back and forth between supplying the first liquid aerosol-forming substrate to the common atomisation region and supplying the second liquid aerosol-forming substrate to the common atomisation region.

Advantageously, alternating between atomising the first and second liquid aerosol-forming substrates provides an alternating delivery of first and second aerosols to a user. The controller may be configured to receive a user input indicative of a user choice between delivering the first aerosol or the second aerosol. The controller may be configured to provide either the first flow signal or the second flow signal dependent on the user input.

The controller may be configured to rapidly alternate between providing the first flow signal and the second flow signal. The controller may be configured to alternate between providing the first flow signal and the second flow signal at least once every 1 second, preferably at least one every 0.1 seconds. Advantageously, rapidly alternating delivery of first and second aerosols may be perceived by a user as a concurrent delivery of the first and second aerosols.

The at least one atomisation region may comprise a first atomisation region positioned on the active surface of the substrate to receive surface acoustic waves generated by the first transducer and a second atomisation region positioned on the active surface of the substrate to receive surface acoustic waves generated by the second transducer. Preferably, the first supply element is arranged to supply the first liquid aerosol-forming substrate to the first atomisation region and the second supply element is arranged to supply the second liquid aerosol-forming substrate to the second atomisation region.

Advantageously, supplying the first and second liquid aerosol-forming substrates to first and second atomisation regions facilitates concurrent but separate atomisation of the first and second liquid aerosol-forming substrates. Advantageously, concurrent atomisation of the first and second liquid aerosol-forming substrates facilitates mixing of aerosols generated from the first and second aerosol-forming substrates. Advantageously, separate atomisation of the first and second liquid aerosol-forming substrates facilitates tailoring of atomisation parameters for each of the first and second liquid aerosol-forming substrates. For example, each of the first and second transducers may be configured specifically for atomising the first and second liquid aerosol-forming substrates respectively. In particular, the configuration of each of the first and second transducers may depend on one or more fluid properties of the first and second liquid aerosol-forming substrates, such as volatility or viscosity.

The first supply element may comprise a first channel extending through the substrate. The first channel may be a capillary tube. The first channel may extend between a first inlet on a passive surface of the substrate and a first outlet on the active surface of the substrate, wherein the first outlet is positioned within the first atomisation region.

The second supply element may comprise a second channel extending through the substrate. The second channel may be a capillary tube. The second channel may extend between a second inlet on a passive surface of the substrate and a second outlet on the active surface of the substrate, wherein the second outlet is positioned within the second atomisation region.

The first supply element may comprise the first transducer. During use, surface acoustic waves generated by the first transducer may draw a first liquid aerosol-forming substrate into the at least one atomisation region. In other words, the first liquid aerosol-forming substrate is drawn into the at least one atomisation region only when the controller provides the first drive signal to the first transducer. In embodiments in which the first supply element comprises a first channel, surface acoustic waves generated by the first transducer may draw a first liquid aerosol-forming substrate through the first channel.

The second supply element may comprise the second transducer. During use, surface acoustic waves generated by the second transducer may draw a second liquid aerosol-forming substrate into the at least one atomisation region. In other words, the second liquid aerosol-forming substrate is drawn into the at least one atomisation region only when the controller provides the second drive signal to the second transducer. In embodiments in which the second supply element comprises a second channel, surface acoustic waves generated by the second transducer may draw a second liquid aerosol-forming substrate through the second channel.

The first supply element may comprise a first flow control element arranged to control a flow of the first liquid aerosol-forming substrate to the first atomisation region. In embodiments in which the first supply element comprises a first channel, preferably the first flow control element is arranged to control a flow of the first aerosol-forming substrate through the first inlet and into the first channel.

The second supply element may comprise a second flow control element arranged to control a flow of the second liquid aerosol-forming substrate to the second atomisation region. In embodiments in which the second supply element comprises a second channel, preferably the second flow control element is arranged to control a flow of the second aerosol-forming substrate through the second inlet and into the second channel.

Each of the first and second flow control elements may comprise at least one passive element. The at least one passive element may comprise at least one of a capillary tube and a capillary wick.

Each of the first and second flow control elements may comprise at least one active element. The at least one active element may comprise at least one of a micro pump, a syringe pump, a piston pump, and an electroosmotic pump.

Preferably, the controller is configured to provide a first flow signal to the first flow control element to enable a flow of the first liquid aerosol-forming substrate to the first atomisation region. Preferably, the controller is configured to provide a second flow signal to the second flow control element to enable a flow of the second liquid aerosol-forming substrate to the second atomisation region. Preferably, the controller is configured to provide a first stop signal to the first control element to disable the flow of the first liquid aerosol-forming substrate. Preferably, the controller is configured to provide a second stop signal to the second control element to disable the flow of the second liquid aerosol-forming substrate.

Preferably, the controller is configured to provide the first drive signal to the first transducer only when the first liquid aerosol-forming substrate is supplied to the first atomisation region by the first supply element. Preferably, the controller is configured to provide the second drive signal to the second transducer only when the second liquid aerosol-forming substrate is supplied to the second atomisation region by the second supply element.

The surface acoustic wave atomiser may comprise at least one reflector. Preferably, the at least one reflector is positioned on the active surface of the at least one substrate. Preferably, the at least one reflector is arranged to reflect surface acoustic waves generated by at least one of the first transducer and the second transducer. Preferably, the at least one reflector is arranged to reflect surface acoustic waves generated by at least one of the first transducer and the second transducer towards the at least one atomisation region. Advantageously, a reflector arranged to reflect surface acoustic waves towards the at least one atomisation region may increase or maximise the efficiency of the surface acoustic wave atomiser. The at least one reflector may be arranged to reflect surface acoustic waves generated by each of the first transducer and the second transducer towards the at least one atomisation region.

In embodiments in which the at least one atomisation region comprises a first atomisation region and a second atomisation region, the at least one reflector may comprise a common reflector, wherein the first atomisation region is positioned between the common reflector and the first transducer, and wherein the second atomisation region is positioned between the common reflector and the second transducer.

Advantageously, providing a common reflector may simplify the design and constructions of the surface acoustic wave atomiser.

Advantageously, the common reflector may prevent surface acoustic waves generated by the first transducer being transmitted to the second atomisation region.

Advantageously, the common reflector may prevent surface acoustic waves generated by the second transducer being transmitted to the first atomisation region.

The at least one reflector may comprise one or more electrodes.

The at least one reflector may comprise one or more portions of metal positioned on the active surface of the at least one substrate. Each portion of metal may have a linear shape. Each portion of metal may have a curved shape. The at least one reflector may comprise a plurality of portions of metal. The plurality of portions of metal may be arranged in a pattern on the active surface of the at least one substrate. Preferably, each portion of metal is substantially parallel to the adjacent portions of metal forming the at least one reflector.

A portion of the at least one substrate may form at least part of the at least one reflector. The at least one substrate may define at least one protrusion, wherein the at least one protrusion forms at least part of the at least one reflector. The at least one substrate may define at least one recess, wherein the at least one recess forms at least part of the at least one reflector.

The surface acoustic wave atomiser may comprise at least one absorber. Preferably, the at least one absorber is positioned on the active surface of the at least one substrate. Preferably, the at least one absorber is arranged to absorb surface acoustic waves generated by at least one of the first transducer and the second transducer.

In embodiments in which the at least one atomisation region comprises a first atomisation region and a second atomisation region, the at least one absorber may comprise a common absorber, wherein the first atomisation region is positioned between the common absorber and the first transducer, and wherein the second atomisation region is positioned between the common absorber and the second transducer.

Advantageously, providing a common absorber may simplify the design and constructions of the surface acoustic wave atomiser.

Advantageously, the common absorber may prevent surface acoustic waves generated by the first transducer being transmitted to the second atomisation region.

Advantageously, the common absorber may prevent surface acoustic waves generated by the second transducer being transmitted to the first atomisation region.

The at least one absorber may comprise a material having at least one of a low density, a low speed of sound and a high viscosity. The at least one absorber may comprise polydimethylsiloxane.

A portion of the at least one substrate may form at least part of the at least one absorber. The at least one substrate may define at least one protrusion, wherein the at least one protrusion forms at least part of the at least one absorber. The at least one substrate may define at least one recess, wherein the at least one recess forms at least part of the at least one absorber.

The aerosol-generator may comprise a third transducer positioned on the active surface of the at least one substrate and a third supply element arranged to supply a third liquid aerosol-forming substrate to the at least one atomisation region. Preferably, the controller is configured to provide a third drive signal to the third transducer for generating surface acoustic waves on the active surface of the at least one substrate, wherein the controller is configured to provide the third drive signal to the third transducer only when the third liquid aerosol-forming substrate is supplied to the at least one atomisation region by the third supply element.

In embodiments in which the at least one substrate comprises a common substrate, preferably the third transducer is positioned on the common substrate.

In embodiments in which the aerosol-generator comprises a common supply element, the third supply element may comprise a third channel extending at least partially through the substrate. The third channel may be a capillary tube. The third channel may extend between a third inlet on a passive surface of the substrate and the common channel.

The third supply element may comprise the third transducer. During use, surface acoustic waves generated by the third transducer may draw a third liquid aerosol-forming substrate into the at least one atomisation region. In other words, the third liquid aerosol-forming substrate is drawn into the at least one atomisation region only when the controller provides the third drive signal to the third transducer. In embodiments in which the third supply element comprises a third channel, surface acoustic waves generated by the third transducer may draw a third liquid aerosol-forming substrate through the third channel.

The third supply element may comprise a third flow control element arranged to control a flow of the third liquid aerosol-forming substrate to the common atomisation region. In embodiments in which the third supply element comprises a third channel, preferably the third flow control element is arranged to control a flow of the third aerosol-forming substrate through the third inlet and into the third channel.

The third flow control element may comprise at least one passive element. The at least one passive element may comprise at least one of a capillary tube and a capillary wick.

The third flow control element may comprise at least one active element. The at least one active element may comprise at least one of a micro pump, a syringe pump, a piston pump, and an electroosmotic pump.

Preferably, the controller is configured to provide a third flow signal to the third flow control element to enable a flow of the third liquid aerosol-forming substrate to the common atomisation region. Preferably, the controller is configured to provide a third stop signal to the third control element to disable the flow of the third liquid aerosol-forming substrate when the controller provides the first flow signal to the first control element or the second flow signal to the second control element.

In embodiments in which the at least one atomisation region comprises a first atomisation region and a second atomisation region, the at least one atomisation region may further comprise a third atomisation region positioned on the active surface to receive surface acoustic waves generated by the third transducer, wherein the third supply element is arranged to supply the third liquid aerosol-forming substrate to the third atomisation region.

The third supply element may comprise a third channel extending through the substrate. The third channel may be a capillary tube. The third channel may extend between a third inlet on a passive surface of the substrate and a third outlet on the active surface of the substrate, wherein the third outlet is positioned within the third atomisation region.

The third supply element may comprise the third transducer. During use, surface acoustic waves generated by the third transducer may draw a third liquid aerosol-forming substrate into the at least one atomisation region. In other words, the third liquid aerosol-forming substrate is drawn into the at least one atomisation region only when the controller provides the third drive signal to the third transducer. In embodiments in which the third supply element comprises a third channel, surface acoustic waves generated by the third transducer may draw a third liquid aerosol-forming substrate through the third channel.

The third supply element may comprise a third flow control element arranged to control a flow of the third liquid aerosol-forming substrate to the third atomisation region. In embodiments in which the third supply element comprises a third channel, preferably the third flow control element is arranged to control a flow of the third aerosol-forming substrate through the third inlet and into the third channel.

The third flow control element may comprise at least one passive element. The at least one passive element may comprise at least one of a capillary tube and a capillary wick.

The third flow control element may comprise at least one active element. The at least one active element may comprise at least one of a micro pump, a syringe pump, a piston pump, and an electroosmotic pump.

Preferably, the controller is configured to provide a third flow signal to the third flow control element to enable a flow of the third liquid aerosol-forming substrate to the third atomisation region. Preferably, the controller is configured to provide a third stop signal to the third control element to disable the flow of the third liquid aerosol-forming substrate.

Preferably, the controller is configured to provide the third drive signal to the third transducer only when the third liquid aerosol-forming substrate is supplied to the third atomisation region by the third supply element.

In embodiments in which the surface acoustic wave atomiser comprises at least one reflector, the at least one reflector may be arranged to reflect surface acoustic waves generated by the third transducer. The at least one reflector may be arranged to reflect surface acoustic waves generated by the third transducer towards the at least one atomisation region.

In embodiments in which the at least one atomisation region comprises a first atomisation region, a second atomisation region and a third atomisation region, the at least one reflector may comprise a common reflector, wherein the first atomisation region is positioned between the common reflector and the first transducer, wherein the second atomisation region is positioned between the common reflector and the second transducer, and wherein the third atomisation region is positioned between the common reflector and the third transducer.

The common reflector may have a tricuspoid shape. Advantageously, a tricuspoid shape may facilitate an efficient arrangement of the first, second and third transducers on the active surface of the at least one substrate.

In embodiments in which the surface acoustic wave atomiser comprises at least one absorber, the at least one absorber may be arranged to absorb surface acoustic waves generated by the third transducer.

In embodiments in which the at least one atomisation region comprises a first atomisation region, a second atomisation region and a third atomisation region, the at least one absorber may comprise a common absorber, wherein the first atomisation region is positioned between the common absorber and the first transducer, wherein the second atomisation region is positioned between the common absorber and the second transducer, and wherein the third atomisation region is positioned between the common absorber and the third transducer.

The common absorber may have a tricuspoid shape. Advantageously, a tricuspoid shape may facilitate an efficient arrangement of the first, second and third transducers on the active surface of the at least one substrate.

The following preferred and optional features of the aerosol generator may be applied to any of the aspects and embodiments described herein.

Each of the first transducer, the second transducer, and the third transducer may comprise an interdigital transducer comprising a plurality of electrodes. Preferably, the plurality of electrodes are substantially parallel with each other. Preferably, the interdigital transducer comprises a first array of electrodes and a second array of electrodes interleaved with the first array of electrodes. Preferably, the first array of electrodes is substantially parallel with the second array of electrodes.

Each of the first transducer, the second transducer, and the third transducer may be configured to generate surface acoustic waves having a substantially linear wavefront. In embodiments in which the transducer is an interdigital transducer comprising a plurality of electrodes, each electrode may be substantially linear.

Each of the first transducer, the second transducer, and the third transducer may be configured to generate surface acoustic waves having a curved wavefront. In embodiments in which the transducer is an interdigital transducer comprising a plurality of electrodes, each electrode may be curved. The transducer may be configured to generate surface acoustic waves having a convex wavefront. Preferably, the transducer may be configured to generate surface acoustic waves having a concave wavefront. Advantageously, a concave wavefront may provide a focusing effect. In other words, a concave wavefront may focus the generated surface acoustic waves towards an atomisation region that is smaller than the transducer. Advantageously, focusing the generated surface acoustic waves may increase the rate at which energy is delivered to a liquid aerosol-forming substrate in the atomisation region.

The substrate is formed from a substrate material. The substrate may be a piezoelectric material. The substrate material may comprise a monocrystalline material. The substrate material may comprise a polycrystalline material. The substrate material may comprise at least one of quartz, a ceramic, barium titanate ($BaTiO_3$), and lithium niobate ($LiNbO_3$). The ceramic may comprise lead zirconate titanate (PZT). The ceramic may include doping materials such as Ni, Bi, La, Nd or Nb ions. The substrate material may be polarised. The substrate material may be unpolarised. The substrate material may comprise both polarised and unpolarised materials.

The substrate may comprise a surface treatment. The surface treatment may be applied to the active surface of the substrate. The surface treatment may comprise a coating. The coating may comprise a hydrophobic material. The coating may comprise a hydrophilic material. The coating may comprise an oleophobic material. The coating may comprise an oleophilic material.

According to a second aspect of the present disclosure there is provided an aerosol-generating device comprising an aerosol generator according to the first aspect of the present disclosure, in accordance with any of the embodiments described herein. The aerosol-generating device also comprises a power supply, a first liquid storage portion and a second liquid storage portion. The first liquid storage portion is for receiving the first liquid aerosol-forming substrate, wherein the first supply element is arranged to supply the first liquid aerosol-forming substrate from the first liquid storage portion to the at least one atomisation region. The second liquid storage portion is for receiving the second liquid aerosol-forming substrate, wherein the second supply element is arranged to supply the second liquid aerosol-forming substrate from the second liquid storage portion to the at least one atomisation region.

In embodiments in which the aerosol generator comprises a third transducer and a third supply element arranged to supply a third liquid aerosol-forming substrate to the at least one atomisation region, preferably the aerosol-generating device comprises a third liquid storage portion. Preferably, the third liquid storage portion is for receiving the third liquid aerosol-forming substrate, wherein the third supply element is arranged to supply the third liquid aerosol-forming substrate from the third liquid storage portion to the at least one atomisation region.

Each of the first, second and third liquid storage portions may be reusable. In other words, each liquid storage portion may be refillable by a user to replenish a liquid aerosol-forming substrate in the liquid storage portion. Each liquid storage portion may comprise a refill aperture for inserting a liquid aerosol-forming substrate into the liquid storage portion. Each liquid storage portion may comprise a refill valve between the refill aperture and the liquid storage portion. Advantageously, the refill valve may allow a liquid aerosol-forming substrate to flow through the refill aperture into the liquid storage portion. Advantageously, the refill valve may prevent a liquid aerosol-forming substrate from flowing out of the liquid storage portion through the refill aperture.

Each of the first, second and third liquid storage portions may be replaceable. Each liquid storage portion may be removable from the aerosol-generating device. The aerosol-generating device may comprise a cartridge, wherein the cartridge is removable from the aerosol-generating device, and wherein the cartridge comprises the first, second and third liquid storage portions.

The aerosol-generating device may comprise a first liquid aerosol-forming substrate contained within the first liquid storage portion.

The aerosol-generating device may comprise a second liquid aerosol-forming substrate contained within the second liquid storage portion.

The aerosol-generating device may comprise a third liquid aerosol-forming substrate contained within the third liquid storage portion.

At least one of the first, second and third liquid aerosol-forming substrates may comprise nicotine. The nicotine containing liquid aerosol-forming substrate may be a nicotine salt matrix. The liquid aerosol-forming substrate may comprise plant-based material. The liquid aerosol-forming substrate may comprise tobacco. The liquid aerosol-forming substrate may comprise homogenised tobacco material. The liquid aerosol-forming substrate may comprise a non-tobacco-containing material. The liquid aerosol-forming substrate may comprise homogenised plant-based material.

At least one of the first, second and third liquid aerosol-forming substrates may comprise at least one aerosol-former. An aerosol-former is any suitable known compound or mixture of compounds that, in use, facilitates formation of a dense and stable aerosol. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Aerosol formers may be polyhydric alcohols or mixtures thereof, such as triethylene glycol, 1,3-butanediol and glycerine. The liquid aerosol-forming substrate may comprise other additives and ingredients, such as flavourants.

At least one of the first, second and third liquid aerosol-forming substrates may comprise water.

At least one of the first, second and third liquid aerosol-forming substrates may comprise nicotine and at least one aerosol former. The aerosol former may comprise glycerine. The aerosol-former may comprise propylene glycol. The aerosol former may comprise both glycerine and propylene glycol. The liquid aerosol-forming substrate may have a nicotine concentration of between about 0.1 percent and about 10 percent.

The controller may comprise electric circuitry connected to the power supply and the first, second and third transducers. The electric circuitry may comprise a microprocessor. The microprocessor may be a programmable microprocessor, a microcontroller, or an application specific integrated chip (ASIC) or other electronic circuitry capable of providing control. The electric circuitry may comprise further electronic components. The electric circuitry may be configured to regulate a supply of power from the power supply to each of the first, second and third transducers. The controller may be configured to supply power continuously to at least one of the first, second and third transducers following activation of the aerosol-generative device. The controller may be configured to supply power intermittently to at least one of the first, second and third transducers. The controller may be configured to supply power to at least one of the first, second and third transducers on a puff-by-puff basis.

Preferably, the controller and the power supply are configured to provide an alternating voltage to each of the first, second and third transducers. Preferably, the alternating voltage is a radio frequency alternating voltage. Preferably, the alternating voltage has a frequency of at least about 20 megahertz. Preferably, the alternating voltage has a frequency of between about 20 megahertz and about 100 megahertz, more preferably between about 20 megahertz and about 80 megahertz. Advantageously, an alternating voltage within these ranges may provide at least one of a desired rate of aerosol generating and a desired droplet size.

The power supply may be any suitable type of power supply. The power supply may be a DC power supply. In some preferred embodiments, the power supply is a battery, such as a rechargeable lithium ion battery. The power supply may be another form of charge storage device, such as a capacitor. The power supply may require recharging. The power supply may have a capacity that allows for the storage of enough energy for one or more uses of the device. For example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of uses of the device or discrete activations. In one embodiment, the power supply is a DC power supply having a DC supply voltage in the range of about 2.5 Volts to about 4.5 Volts and a DC supply current in the range of about 1 Amp to about 10 Amps (corresponding to a DC power supply in the range of about 2.5 Watts to about 45 Watts).

The aerosol-generating device may advantageously comprise a DC/AC inverter, which may comprise a Class-C, Class-D or Class-E power amplifier. The DC/AC inverter may be arranged between the power supply and each of the first, second and third transducers.

The aerosol-generating device may further comprise a DC/DC converter between the power supply and the DC/AC inverter.

The aerosol-generating device may comprise a device housing. The device housing may be elongate. The device housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

The device housing may define an air inlet. The air inlet may be configured to enable ambient air to enter the device housing. The air inlet may be in fluid communication with the at least one atomisation region of the aerosol generator. The device may comprise any suitable number of air inlets. The device may comprise a plurality of air inlets.

The device housing may comprise an air outlet. The air outlet may be configured to enable air to exit the device housing for delivery to a user. The air outlet may be in fluid communication with the at least one atomisation region of the aerosol generator. The aerosol-generating device may comprise a mouthpiece. The mouthpiece may comprise the air outlet. The device may comprise any suitable number of air outlets. The device may comprise a plurality of air outlets.

The invention will be further described, by way of example only, with reference to the accompanying drawings, in which.

Figure 1:
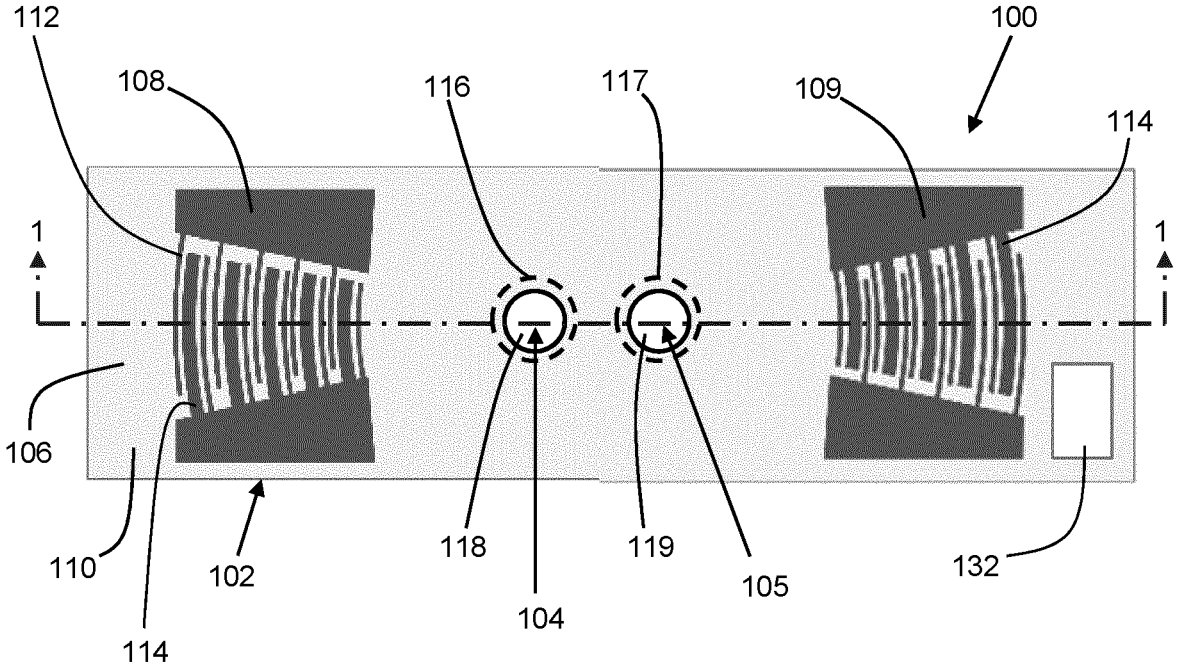
FIG. 1 shows a top view of an aerosol-generator according to a first embodiment of the present disclosure.
Figure 2:
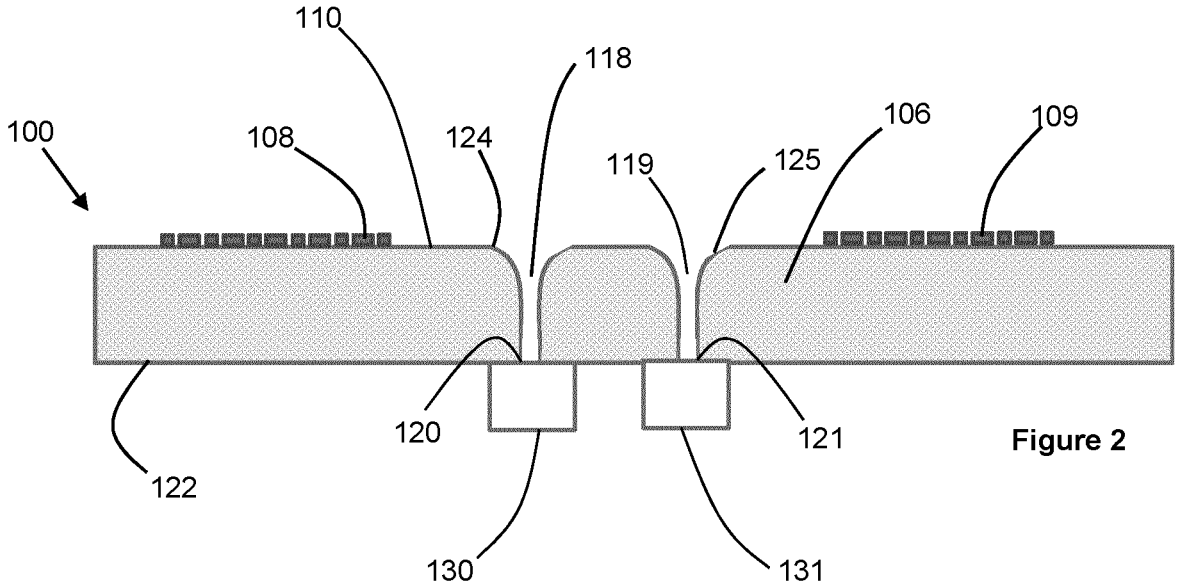
FIG. 2 shows a cross-sectional view of the aerosol-generator of FIG. 1 taken along line 1-1.

FIGS. 1 and 2 show an aerosol-generator 100 according to a first embodiment of the present disclosure. The aerosol-generator 100 comprises a surface acoustic wave atomiser 102, a first supply element 104 for supplying a first liquid aerosol-forming substrate to the surface acoustic wave atomiser 102, and a second supply element 105 for supplying a second liquid aerosol-forming substrate to the surface acoustic wave atomiser 102.

The surface acoustic wave atomiser 102 comprises a substrate 106 comprising a sheet of piezoelectric material, a first transducer 108 arranged on an active surface 110 of the substrate 106, and a second transducer 109 arranged on the active surface 110 of the substrate 106. Each of the first and second transducers 108, 109 comprises a first array of electrodes 112 and a second array of electrodes 114 interleaved with the first array of electrodes 112. The first and second arrays of electrodes 112, 114 are curved and parallel with each other. During use, each of the first and second transducers 108, 109 generates surface acoustic waves on the active surface 110 of the substrate 106. The curved shape of the first and second arrays of electrodes 112, 114 results in surface acoustic waves having a concave wavefront. The concave wavefront of surface acoustic waves generated by the first transducer 108 are focused towards a first atomisation region 116 on the active surface 110 of the substrate 106. The concave wavefront of surface acoustic waves generated by the second transducer 109 are focused towards a second atomisation region 117 on the active surface 110 of the substrate 106.

The first supply element 104 comprises a first channel 118 extending through the substrate 106 between a first inlet 120 at a passive surface 122 of the substrate 106 and a first outlet 124 at the active surface 110 of the substrate 106. The first outlet 124 is positioned within the first atomisation region 116. The first supply element 104 also comprises a first flow control element 130 comprising a micro pump. During use, a first liquid aerosol-forming substrate is supplied by the first flow control element 130 through the first channel 118 to the first atomisation region 116 where it is atomised by surface acoustic waves generated by the first transducer 108.

The second supply element 105 comprises a second channel 119 extending through the substrate 106 between a second inlet 121 at the passive surface 122 of the substrate 106 and a second outlet 125 at the active surface 110 of the substrate 106. The second outlet 125 is positioned within the second atomisation region 117. The second supply element 105 also comprises a second flow control element 131 comprising a micro pump. During use, a second liquid aerosol-forming substrate is supplied by the second flow control element 131 through the second channel 119 to the second atomisation region 117 where it is atomised by surface acoustic waves generated by the second transducer 109.

The aerosol-generator 100 also comprises a controller 132 arranged to control the first and second transducers 108, 109 and the first and second flow control elements 130, 131. In the embodiment shown in FIG. 1 the controller 132 is positioned on the substrate 106 of the surface acoustic wave atomiser 102; however, the skilled person will appreciate that the controller 132 may be provided separately from the surface acoustic wave atomiser 102.

The controller 132 is configured to provide a first drive signal to the first transducer 108 for generating surface acoustic waves on the active surface 110 of the substrate 106. The controller 132 is also configured to provide first flow signals and first stop signals to the first flow control element 130 to start and stop a flow of a first liquid aerosol-forming substrate through the first channel 118 and into the first atomisation region 116. The controller 132 is configured to provide the first drive signal to the first transducer 108 only when the first flow control element 130 is supplying the first liquid aerosol-forming substrate to the first atomisation region 116.

The controller 132 is configured to provide a second drive signal to the second transducer 109 for generating surface acoustic waves on the active surface 110 of the substrate 106. The controller 132 is also configured to provide second flow signals and second stop signals to the second flow control element 131 to start and stop a flow of a second liquid aerosol-forming substrate through the second channel 119 and into the second atomisation region 117. The controller 132 is configured to provide the second drive signal to the second transducer 109 only when the second flow control element 131 is supplying the second liquid aerosol-forming substrate to the second atomisation region 117.

Figure 3:
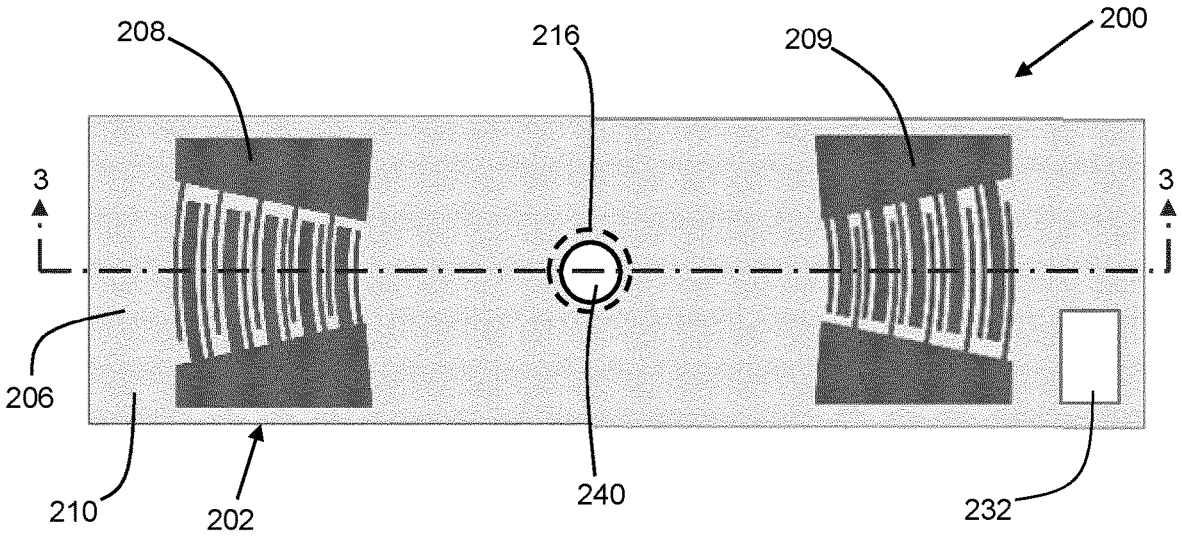
FIG. 3 shows a top view of an aerosol-generator according to a second embodiment of the present disclosure.
Figure 4:
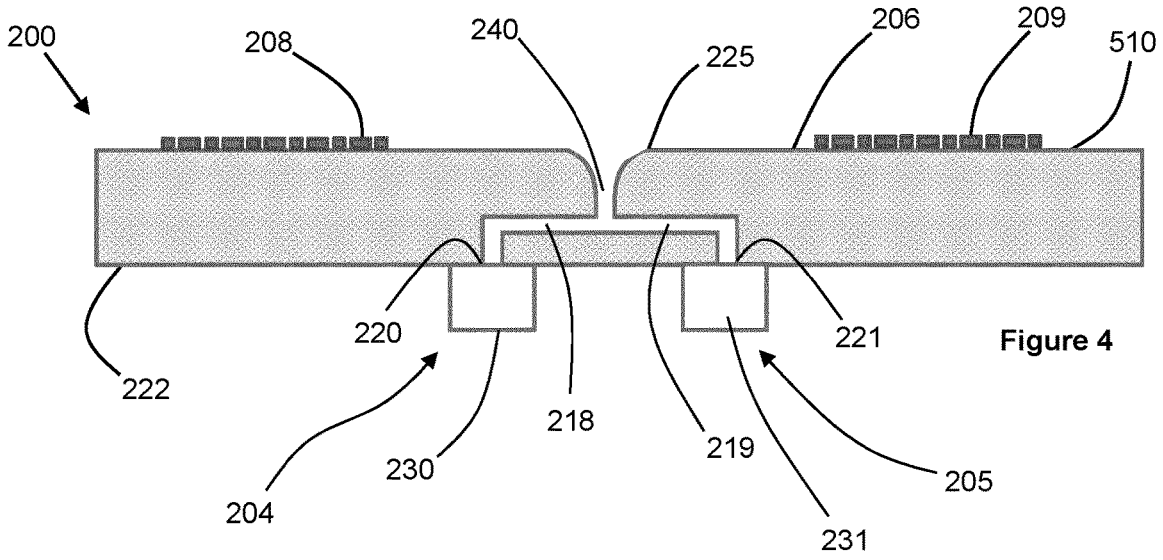
FIG. 4 shows a cross-sectional view of the aerosol-generator of FIG. 3 taken along line 3-3.

FIGS. 3 and 4 show an aerosol-generator 200 according to a second embodiment of the present disclosure. The aerosol-generator 200 comprises a surface acoustic wave atomiser 202, a first supply element 204 for supplying a first liquid aerosol-forming substrate to the surface acoustic wave atomiser 202, and a second supply element 205 for supplying a second liquid aerosol-forming substrate to the surface acoustic wave atomiser 202.

The surface acoustic wave atomiser 202 comprises a substrate 206 comprising a sheet of piezoelectric material, a first transducer 208 arranged on an active surface 210 of the substrate 206, and a second transducer 209 arranged on the active surface 210 of the substrate 206. Each of the first and second transducers 208, 209 comprises first and second arrays of electrodes as described with respect to the first and second transducers 108, 109 of FIG. 1. Surface acoustic waves generated by the first and second transducers 208, 209 are focused towards a common atomisation region 216.

The surface acoustic wave atomiser 202 comprises a common channel 240 extending into the substrate 206 from a common outlet 225 positioned within the common atomisation region 216 at the active surface of the substrate 206.

The first supply element 204 comprises a first channel 218 extending into the substrate 206 from a first inlet 220 at a passive surface 222 of the substrate 206. The first channel 218 is in fluid communication with the common channel 240. The first supply element 204 also comprises a first flow control element 230 comprising a micro pump. During use, a first liquid aerosol-forming substrate is supplied by the first flow control element 230 through the first channel 218 and the common channel 240 to the common atomisation region 216 where it is atomised by surface acoustic waves generated by the first transducer 208.

The second supply element 205 comprises a second channel 219 extending into the substrate 206 from a second inlet 221 at the passive surface 222 of the substrate 206. The second channel 219 is in fluid communication with the common channel 240. The second supply element 205 also comprises a second flow control element 231 comprising a micro pump. During use, a second liquid aerosol-forming substrate is supplied by the second flow control element 231 through the second channel 219 and the common channel 240 to the common atomisation region 216 where it is atomised by surface acoustic waves generated by the second transducer 209.

The aerosol-generator 200 also comprises a controller 232 arranged to control the first and second transducers 208, 209 and the first and second flow control elements 230, 231. In the embodiment shown in FIG. 4 the controller 232 is positioned on the substrate 206 of the surface acoustic wave atomiser 202; however, the skilled person will appreciate that the controller 232 may be provided separately from the surface acoustic wave atomiser 202.

The controller 232 is configured to provide a first drive signal to the first transducer 208 for generating surface acoustic waves on the active surface 210 of the substrate 206. The controller 232 is also configured to provide first flow signals and first stop signals to the first flow control element 230 to start and stop a flow of a first liquid aerosol-forming substrate to the common atomisation region 216 through the first channel 218 and the common channel 240. The controller 232 is configured to provide the first drive signal to the first transducer 208 only when the first flow control element 230 is supplying the first liquid aerosol-forming substrate to the common atomisation region 216.

The controller 232 is configured to provide a second drive signal to the second transducer 209 for generating surface acoustic waves on the active surface 210 of the substrate 206. The controller 232 is also configured to provide second flow signals and second stop signals to the second flow control element 231 to start and stop a flow of a second liquid aerosol-forming substrate to the common atomisation region 216 through the second channel 219 and the common channel 240. The controller 232 is configured to provide the second drive signal to the second transducer 209 only when the second flow control element 231 is supplying the second liquid aerosol-forming substrate to the common atomisation region 216.

The controller 232 is configured to provide the second stop signal to the second flow control element 231 when the controller 232 provides the first flow signal to the first control element 230. The controller 232 is also configured to provide the first stop signal to the first flow control element 230 when the controller 232 provides the second flow signal to the second flow control element 231.

Figure 5:
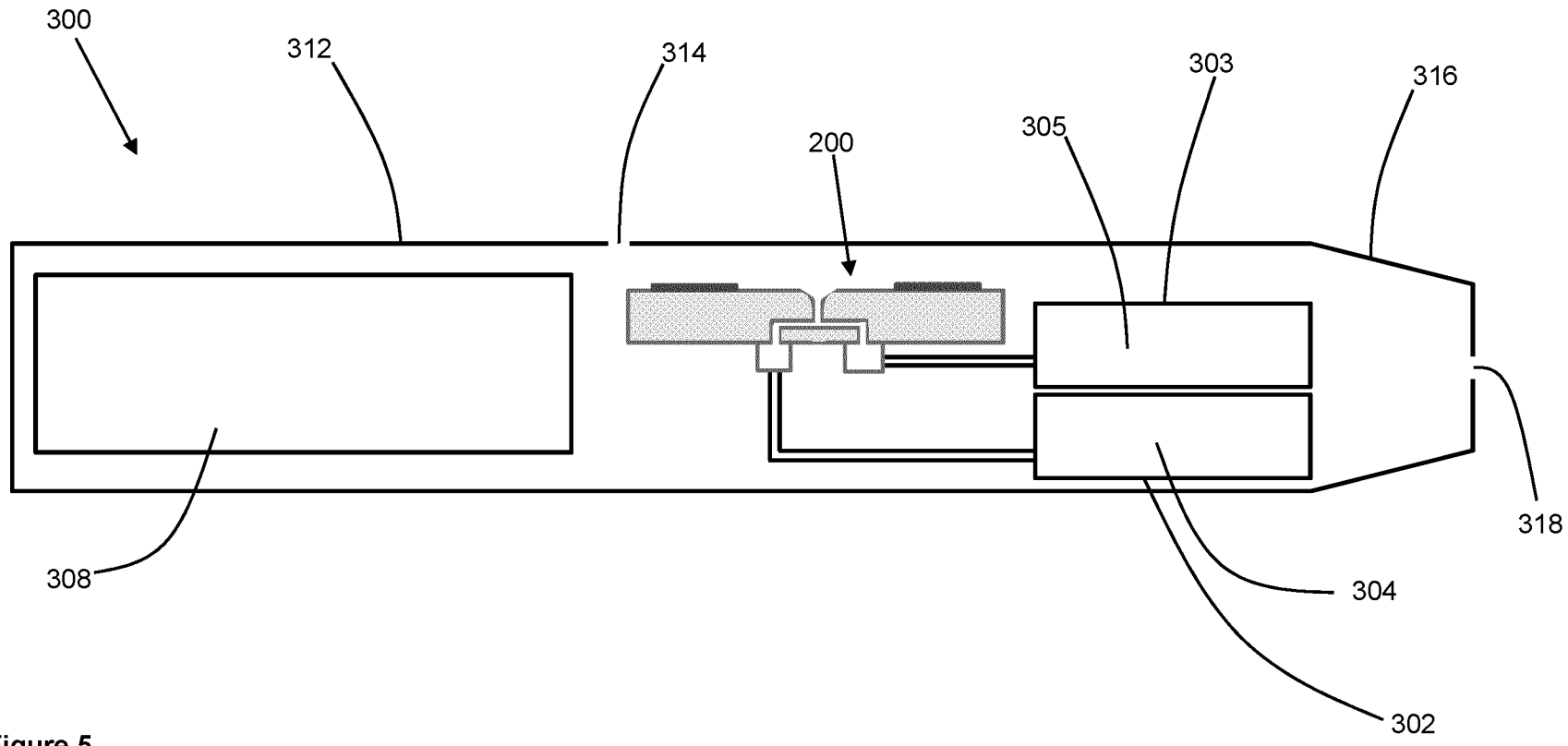
FIG. 5 shows an aerosol-generating device comprising the aerosol-generator of FIG. 3.

FIG. 5 shows a cross-sectional view of an aerosol-generating device 300 comprising the aerosol-generator 200 of FIGS. 3 and 4. The aerosol-generating device 300 also comprises a first liquid storage portion 302 containing a first liquid aerosol-forming substrate 304, and a second liquid storage portion 303 containing a second liquid aerosol-forming substrate 305. The first flow control element 230 of the aerosol-generator 200 is arranged to supply the first liquid aerosol-forming substrate 304 from the first liquid storage portion 302 to the first inlet 220 of the aerosol-generator 200. The second flow control element 231 of the aerosol-generator 200 is arranged to supply the second liquid aerosol-forming substrate 305 from the second liquid storage portion 303 to the second inlet 221 of the aerosol-generator 200.

The aerosol-generating device 300 also comprises a power supply 308 comprising a rechargeable battery for supplying electrical power to the controller 232, the first and second transducers 208, 209 and the first and second flow control elements 230, 231.

The aerosol-generating device 300 also comprises a housing 312 in which the aerosol-generator 200, the first and second liquid storage portions 302, 303, and the power supply 308 are contained. The housing 312 defines an air inlet 314, a mouthpiece 316, and an air outlet 318. During use, a user draws on the mouthpiece 316 to draw air through the housing 312 from the air inlet 314 to the air outlet 318. Aerosol generated by the aerosol-generator 200 is entrained in the airflow through the housing 312 for delivery to the user.

Figure 6:
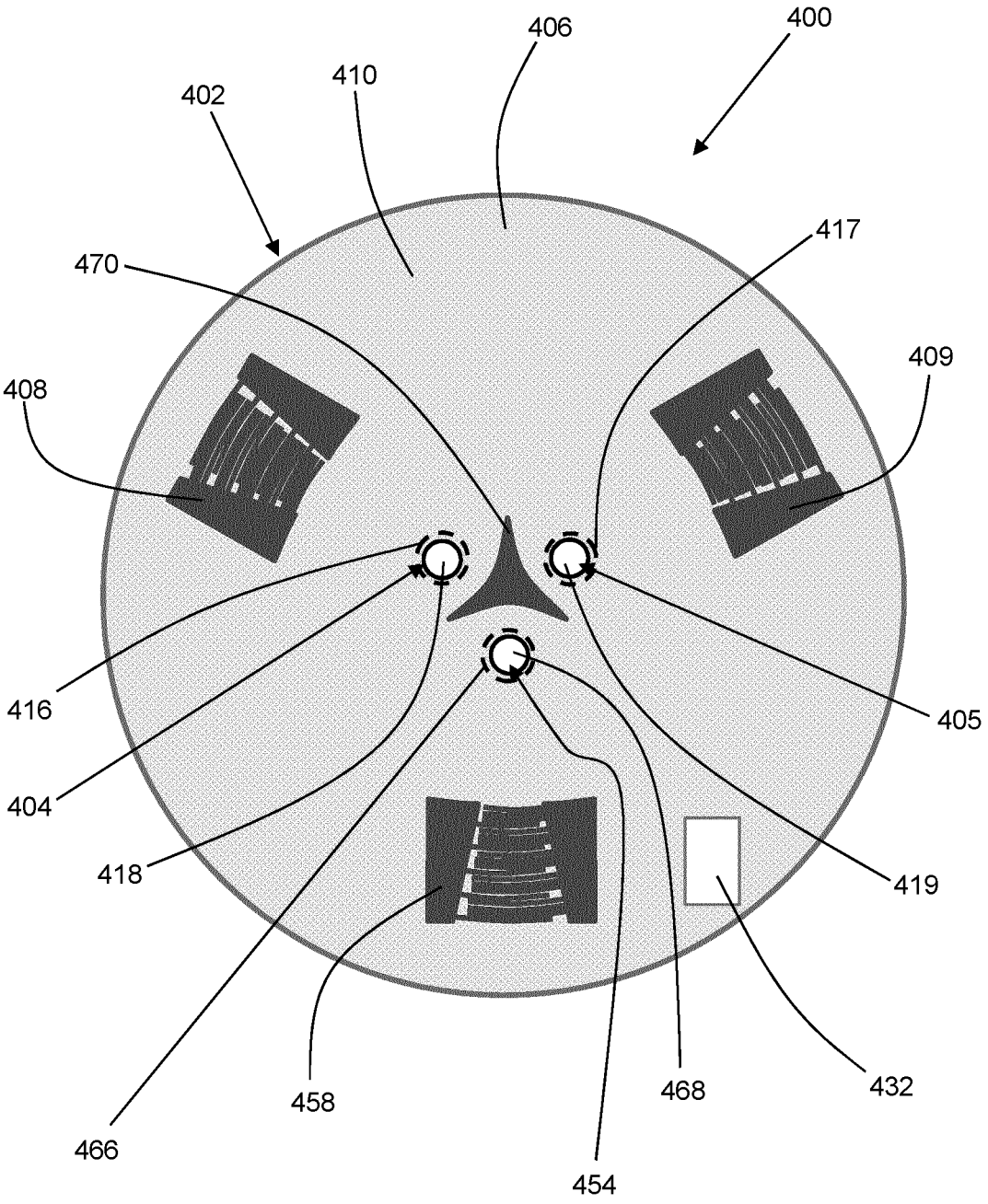
FIG. 6 shows a top view of an aerosol-generator according to a third embodiment of the present disclosure.

FIG. 6 shows a top view of an aerosol generator 400 according to a third embodiment of the present disclosure. The aerosol generator 400 is similar to the aerosol generator 100 of FIGS. 1 and 2, but comprises an additional transducer, atomisation region and supply element. The skilled person will appreciate that the construction and operation of the aerosol generator 400 is otherwise similar to the construction and operation of the aerosol generator 400.

The aerosol generator 400 comprises a surface acoustic wave atomiser 402, a first supply element 404 for supplying a first liquid aerosol-forming substrate to the surface acoustic wave atomiser 402, a second supply element 405 for supplying a second liquid aerosol-forming substrate to the surface acoustic wave atomiser 402, and a third supply element 454 for supplying a third liquid aerosol-forming substrate to the surface acoustic wave atomiser 402.

The surface acoustic wave atomiser 402 comprises a substrate 406 comprising a sheet of piezoelectric material, a first transducer 408 arranged on an active surface 410 of the substrate 406, a second transducer 409 arranged on the active surface 410 of the substrate 406, and a third transducer 458 arranged on the active surface 410 of the substrate 406. Each of the first, second and third transducers 408, 409, 458 comprises first and second arrays of electrodes as described with respect to the first and second transducers 108, 109 of FIG. 1. Surface acoustic waves generated by the first transducer 408 are focused towards a first atomisation region 416. Surface acoustic waves generated by the second transducer 409 are focused towards a second atomisation region 417. Surface acoustic waves generated by the third transducer 458 are focused towards a third atomisation region 466.

The surface acoustic wave atomiser 402 also comprises a reflector 470 having a tricuspid shape and positioned between the first, second and third atomisation regions 416, 417, 466. The reflector 470 is arranged to reflect surface acoustic waves generated by each of the first, second and third transducers 408, 409, 458 towards the respective first, second and third atomisation regions 416, 417, 466. In an alternative embodiment, the reflector 470 may be replaced by an absorber.

The first supply element 404 comprises a first channel 418 extending through the substrate 406 between a first inlet at a passive surface of the substrate 406 and a first outlet at the active surface 410 of the substrate 406. The first outlet is positioned within the first atomisation region 416. The first supply element 404 also comprises a first flow control element comprising a micro pump. During use, a first liquid aerosol-forming substrate is supplied by the first flow control element through the first channel 418 to the first atomisation region 416 where it is atomised by surface acoustic waves generated by the first transducer 408.

The second supply element 405 comprises a second channel 419 extending through the substrate 406 between a second inlet at the passive surface of the substrate 406 and a second outlet at the active surface 410 of the substrate 406. The second outlet is positioned within the second atomisation region 417. The second supply element 405 also comprises a second flow control element comprising a micro pump. During use, a second liquid aerosol-forming substrate is supplied by the second flow control element through the second channel 419 to the second atomisation region 417 where it is atomised by surface acoustic waves generated by the second transducer 409.

The third supply element 454 comprises a third channel 468 extending through the substrate 406 between a third inlet at the passive surface of the substrate 406 and a third outlet at the active surface 410 of the substrate 406. The third outlet is positioned within the third atomisation region 466. The third supply element 454 also comprises a third flow control element comprising a micro pump. During use, a third liquid aerosol-forming substrate is supplied by the third flow control element through the third channel 468 to the third atomisation region 466 where it is atomised by surface acoustic waves generated by the third transducer 458.

The aerosol-generator 400 also comprises a controller 432 arranged to control the first, second and third transducers 408, 409, 458 and the first, second and third flow control elements. In the embodiment shown in FIG. 6 the controller 432 is positioned on the substrate 406 of the surface acoustic wave atomiser 402; however, the skilled person will appreciate that the controller 432 may be provided separately from the surface acoustic wave atomiser 402.

The controller 432 is configured to provide a first drive signal to the first transducer 408 for generating surface acoustic waves on the active surface 410 of the substrate 406. The controller 432 is also configured to provide first flow signals and first stop signals to the first flow control element to start and stop a flow of a first liquid aerosol-forming substrate through the first channel 418 and into the first atomisation region 416. The controller 432 is configured to provide the first drive signal to the first transducer 408 only when the first flow control element is supplying the first liquid aerosol-forming substrate to the first atomisation region 416.

The controller 432 is configured to provide a second drive signal to the second transducer 409 for generating surface acoustic waves on the active surface 410 of the substrate 406. The controller 432 is also configured to provide second flow signals and second stop signals to the second flow control element to start and stop a flow of a second liquid aerosol-forming substrate through the second channel 419 and into the second atomisation region 417. The controller 432 is configured to provide the second drive signal to the second transducer 409 only when the second flow control element is supplying the second liquid aerosol-forming substrate to the second atomisation region 417.

The controller 432 is configured to provide a third drive signal to the third transducer 458 for generating surface acoustic waves on the active surface 410 of the substrate 406. The controller 432 is also configured to provide third flow signals and third stop signals to the third flow control element to start and stop a flow of a third liquid aerosol-forming substrate through the third channel 468 and into the third atomisation region 466. The controller 432 is configured to provide the third drive signal to the third transducer 458 only when the third flow control element is supplying the third liquid aerosol-forming substrate to the third atomisation region 466.

The invention claimed is:

1. An aerosol-generator for an aerosol-generating device, the aerosol-generator comprising:
- a surface acoustic wave atomiser comprising:
  - at least one substrate comprising an active surface defining at least one atomisation region,
  - a first transducer positioned on the active surface of the at least one substrate, and
  - a second transducer positioned on the active surface of the at least one substrate;
- a first supply element arranged to supply a first liquid aerosol-forming substrate to the at least one atomisation region;
- a second supply element arranged to supply a second liquid aerosol-forming substrate to the at least one atomisation region;
- at least one common reflector positioned on the active surface of the at least one substrate and being configured to reflect surface acoustic waves generated by the first transducer and the second transducer; and
- a controller configured to:
  - provide a first drive signal to the first transducer to generate surface acoustic waves on the active surface of the at least one substrate,
  - provide a second drive signal to the second transducer to generate surface acoustic waves on the active surface of the at least one substrate,
  - provide the first drive signal to the first transducer only when the first liquid aerosol-forming substrate is supplied to the at least one atomisation region by the first supply element, and
  - provide the second drive signal to the second transducer only when the second liquid aerosol-forming substrate is supplied to the at least one atomisation region by the second supply element;
- wherein the at least one atomisation region comprises a first atomisation region positioned on the active surface to receive surface acoustic waves generated by the first transducer and a second atomisation region positioned on the active surface to receive surface acoustic waves generated by the second transducer,
- wherein the first supply element is further arranged to supply the first liquid aerosol-forming substrate to the first atomisation region,
- wherein the second supply element is further arranged to supply the second liquid aerosol-forming substrate to the second atomisation region;
- wherein the at least one reflector comprises a common reflector,
- wherein the first atomisation region is positioned between the common reflector and the first transducer,
- wherein the second atomisation region is positioned between the common reflector and the second transducer;
- wherein the common reflector prevents surface acoustic waves generated by the first transducer being transmitted to the second atomisation region, and
- wherein the common reflector prevents surface acoustic waves generated by the second transducer being transmitted to the first atomisation region.

2. The aerosol-generator according to claim 1, wherein the at least one substrate further comprises a common substrate on which the first transducer and the second transducer are positioned.

3. The aerosol-generator according to claim 2,
- wherein the at least one atomisation region is a common atomisation region defined by the common substrate, and
- wherein the aerosol-generator further comprises a common supply element providing fluid communication between the common atomisation region and each of the first supply element and the second supply element.

4. The aerosol-generator according to claim 3,
- wherein the first supply element comprises a first flow control element configured to control a flow of the first liquid aerosol-forming substrate to the common atomisation region,
- wherein the second supply element comprises a second flow control element configured to control a flow of the second liquid aerosol-forming substrate to the common atomisation region,
- wherein the controller is further configured to:
  - provide a first flow signal to the first flow control element to enable a flow of the first liquid aerosol-forming substrate to the common atomisation region,
  - provide a second flow signal to the second flow control element to enable a flow of the second liquid aerosol-forming substrate to the common atomisation region,
  - provide a first stop signal to the first control element to disable the flow of the first liquid aerosol-forming substrate when the controller provides the second flow signal to the second control element, and provide a second stop signal to the second control element to disable the flow of the second liquid aerosol-forming substrate when the controller provides the first flow signal to the first control element.

5. The aerosol-generator according to claim 1, wherein the controller is further configured to:

provide the first drive signal to the first transducer only when the first liquid aerosol-forming substrate is supplied to the first atomisation region by the first supply element, and provide the second drive signal to the second transducer only when the second liquid aerosol-forming substrate is supplied to the second atomisation region by the second supply element.

6. The aerosol-generator according to claim 1, further comprising at least one absorber positioned on the active surface of the at least one substrate and being configured to absorb surface acoustic waves generated by at least one of the first transducer and the second transducer.

7. The aerosol-generator according to claim 6, wherein the at least one absorber comprises a common absorber, wherein the first atomisation region is positioned between the common absorber and the first transducer, and wherein the second atomisation region is positioned between the common absorber and the second transducer.

8. An aerosol-generating device, comprising:

an aerosol-generator according to claim 1;

a power supply;

a first liquid storage portion configured to receive the first liquid aerosol-forming substrate, wherein the first supply element is further arranged to supply the first liquid aerosol-forming substrate from the first liquid storage portion to the at least one atomisation region; and a second liquid storage portion configured to receive the second liquid aerosol-forming substrate, wherein the second supply element is further arranged to supply the second liquid aerosol-forming substrate from the second liquid storage portion to the at least one atomisation region.

* * * * *